US005267694A

United States Patent [19]

Frank et al.

[11] Patent Number: 5,267,694

[45] Date of Patent: Dec. 7, 1993

[54] FUEL INJECTION NOZZLE FOR INTERNAL COMBUSTION ENGINES

[75] Inventors: Willi Frank, Bamberg; Klaus Dahlmeier, Leonberg-Eltingen; Karl Hoffmann, Neckarrems, all of Fed. Rep. of Germany

[73] Assignee: Robert Bosch GmbH, Stuttgart, Fed. Rep. of Germany

[21] Appl. No.: 795,156

[22] Filed: Nov. 20, 1991

[30] Foreign Application Priority Data

Jan. 17, 1991 [DE] Fed. Rep. of Germany ..... 41012356

[51] Int. Cl.[5] ..... B05B 1/30; F02M 61/04

[52] U.S. Cl. ..... 239/533.5; 239/533.3

[58] Field of Search ..... 239/533.3, 533.4, 533.9, 239/533.2, 533.5, 533.6

[56] References Cited

U.S. PATENT DOCUMENTS

| | | | |
|---|---|---|---|
| 4,403,740 | 9/1983 | Eblen et al. | 239/533.9 |
| 4,768,719 | 9/1988 | Straubel et al. . | |
| 4,848,668 | 7/1989 | Andrews et al. | 239/533.9 |
| 4,856,714 | 8/1989 | Turner | 239/533.9 |
| 4,962,890 | 10/1990 | Shindo et al. | 239/533.9 |
| 5,040,731 | 8/1991 | Yokoyama et al. | 239/585.4 |

FOREIGN PATENT DOCUMENTS

| | | | |
|---|---|---|---|
| 0373466 | 6/1990 | European Pat. Off. | 239/533.9 |
| 0400886 | 12/1990 | European Pat. Off. | 239/533.4 |
| 199433 | 9/1958 | Fed. Rep. of Germany | 239/533.3 |
| 3839038 | 5/1990 | Fed. Rep. of Germany . | |
| 86870 | 5/1954 | Netherlands | 239/533.9 |
| 2226362 | 6/1990 | United Kingdom | 239/533.4 |

*Primary Examiner*—David M. Mitchell
*Assistant Examiner*—Christopher G. Trainor
*Attorney, Agent, or Firm*—Edwin E. Greigg; Ronald E. Greigg

[57] ABSTRACT

A fuel injection nozzle for internal combustion engines having a nozzle body secured on a nozzle holder, and a valve needle that is axially displaceable in the nozzle holder, the valve needle being raised from a valve seat for fuel injection by the fuel pressure, counter to a closing spring assembly of first and second helical compression springs disposed in series. The total stroke of the valve needle is divided into a prestroke and a remaining stroke. To attain an injection nozzle having the smallest possible outside diameter, the spring chamber receiving the closing springs comprises a blind bore of substantially constant diameter, on a bottom of which the first closing spring is supported. To support the second closing spring, a pressure shoulder part in the form of a ring is inserted into the blind bore; the pressure shoulder part is fixed by deformation of contacting parts of the wall of the nozzle holder. Recesses are machined into the circumference of the pressure shoulder part and for easier deformation of portions of the wall of the nozzle holder in the region of the pressure shoulder part, recesses are machined into the outer wall of the pressure shoulder part, with a portion of the wall of the nozzle holder forming the bottom being deformed to form a form-fitting connection with the recesses of the pressure shoulder part.

20 Claims, 1 Drawing Sheet

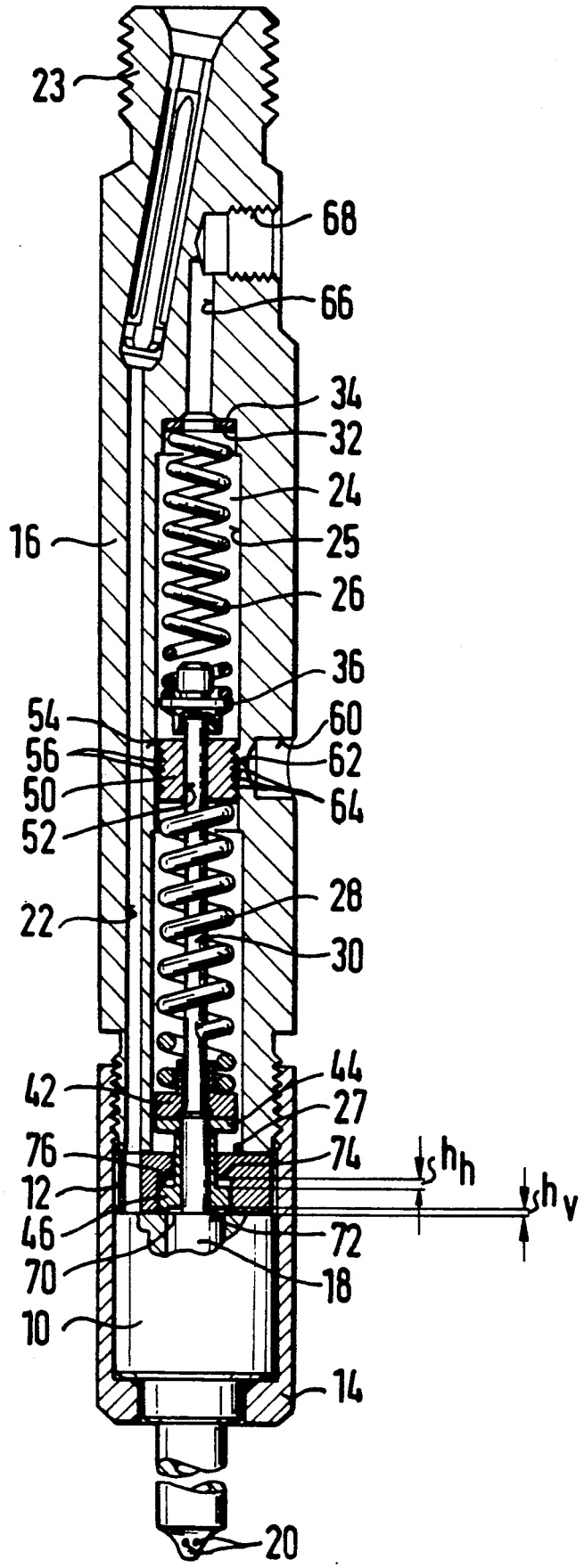
23
68
66
34
32
24
16
25
26
36
54
60
56
62
50
64
52
28
22
30
44
42
27
76
74
$h_h$
12
$h_v$
46
72
70
18
10
14
20

FUEL INJECTION NOZZLE FOR INTERNAL COMBUSTION ENGINES

BACKGROUND OF THE INVENTION

The invention is based on a fuel injection nozzle for internal combustion engines as defined hereinafter. In a known injection nozzle of this type (German Offenlegungsschrift 38 39 038), the spring chamber for the two closing springs has a diameter that remains substantially the same over the entire length, so that the injection nozzle can be kept quite slender, with a small outside diameter. However, the shoulder part serving to support the second closing spring located near the valve needle is embodied by a transverse bolt, which is inserted into a transverse bore that crosses the spring chamber and is open to the outside in the nozzle holder; this impairs the tightness of sealing and the strength of the injection nozzle.

OBJECT AND SUMMARY OF THE INVENTION

The injection nozzle according to the invention has an advantage over the prior art that while a slender embodiment is retained and additional sealing provisions are not needed, a support shoulder for the second closing spring in the nozzle holder is created that can be produced economically.

The provisions recited herein setforth advantageous further features and improvements to the injection nozzle. A particularly durable fastening for the shoulder part is obtained. The forces required for deformation can be limited by embodying the nozzle holder as set forth.

The invention will be better understood and further objects and advantages thereof will become more apparent from the ensuing detailed description of a preferred embodiment taken in conjunction with the drawings.

BRIEF DESCRIPTION OF THE DRAWING

The sole FIGURE of the drawing is a longitudinal section through an injection nozzle in accordance with an exemplary embodiment of the invention.

DESCRIPTION OF THE PREFERRED EMBODIMENT

The injection nozzle has a nozzle body 10, which together with a shim 12 is firmly fastened between one end of a retaining body 16 and a union nut 14. A valve needle 18 is displaceably supported in the nozzle body 10 and cooperates with a valve seat, facing inward, in the nozzle body 10, which has a plurality of injection ports 20. The guide bore of the valve needle 18 is widened in the typical manner at one point to make a pressure chamber, in the region of which the valve needle 18 has a pressure shoulder, and which communicates via a conduit 22 with a connection piece 23 on the retaining body 16 for the attachment of a fuel feed line. The fuel engaging the pressure shoulder of the valve needle 18 displaces the valve needle 18 upward, contrary to the graduated course of force of a closing spring assembly described hereinafter; the fuel is injected into the combustion chamber in a pre-injection phase and a main injection phase, through the injection ports 20.

The retaining body 16 has a spring chamber 24, which is embodied as a blind bore 25 that is coaxial with the valve needle 18; the opening 27 of the blind bore is closed off by the shim 12. In the spring chamber 24, a first closing spring 26 and a second closing spring 28, which are embodied as helical compression springs, are disposed in series. The first closing spring 26, which is farther away from the nozzle body 10, acts continuously via a first thrust bolt 30 upon the valve needle 18 in its closing direction. To this end, the first closing spring 26 is supported via a washer 32 on the bottom 34 of the blind bore 25 and via a spring plate 36 on the upper end of the thrust bolt 30, which rests by its lower end on the upper face end of the valve needle 18.

The second closing spring 28, which may be embodied structurally identical to the first closing spring 26, is disposed in the blind bore 25 adjacent to the nozzle body 10 and surrounds the thrust bar 30. By its lower face end, the second closing spring 28 is supported via a spring plate 42 and a washer 44 on an intermediate liner 46 surrounding the upper end portion of the valve needle 18; as a result, the intermediate liner 46 is pressed against the face end of the nozzle body 10 in the closing position of the valve needle 18. By its other end, this spring is supported on a shoulder part 50 set into the blind bore 25.

The shoulder part 50 is embodied as a ring, the outside diameter of which is adapted to the diameter of the blind bore 25 such that the shoulder part 50 can be pushed or pressed into the blind bore 25 with little play. The thrust bar 30 protrudes with play through the inner bore 52 of the shoulder part 50. The shoulder part 50 is inserted in the middle region of the blind bore 25 at a point such that its face end toward the second closing spring 28 is spaced apart from the support face of the spring plate 42 by a certain distance that is definitive for the prestressing of the second closing spring 28.

A plurality of annular grooves 56 are machined into the circumference 54 of the shoulder part 50. In the region of overlap with the shoulder part 50, a plurality of radial recesses 60, for instance three in number, are machined in the form of countersunk depressions or blind bores into the relatively thick jacket of the retaining body 16, distributed uniformly over its circumference. For securing the shoulder part 50 in the blind bore 25 of the retaining body 16, the wall portion 62 forming the bottom and remaining between the inner wall of the blind bore 25 and the bottom of the recesses 60 is plastically deformed radially inward by pressing or wedging, so that radially inner regions 64 of this wall portion form-fittingly engage the annular grooves 56 of the shoulder part 50. For the sake of this firm retention and disposition of the shoulder part and the retaining body 16, the retaining body 16 and shoulder part 50 are of steel; the shoulder part 50 is preferably of steel having greater strength than that of the retaining body.

The assembly of the injection nozzle is as follows: first the washer 32, the first closing spring 26 and the spring plate 36 are introduced into the blind bore 25 of the retaining body 16. Then the shoulder part 50 is pushed or pressed into the blind bore 25, adjusted in position, and then secured in the region of the recesses 60 by wedging. Finally, the second compression spring 28, the thrust bar 30, the spring plate 42 and the washer 44 are introduced into the blind bore 25, and then after that the shim 12 and nozzle body 10 along with the valve needle 18 and the intermediate liner are braced on the retaining body 16 with the union nut 14.

For the return of leaking oil, the spring chamber 24 communicates, via a conduit 66 beginning at the bottom of the blind bore 25, with a bore 68 for a connection nipple for a leaking oil line. The blind bore 25 for the spring chamber 24 of the retaining body 16 has a substantially constant inside diameter, so that with a constant outside diameter of the retaining body 16, there is great strength despite the small outside diameter. For radial guidance of the two closing springs 26 and 28, the blind bore may be narrowed somewhat near the support point in the bottom 34 and near the shoulder part 50.

In the injection process, the valve needle 18 first executes a prestroke $h_v$, in which only the first closing spring 26 is effective as a contrary force. In this prestroke $h_v$, a limited preinjection quantity is injected from the injection ports 20. The prestroke $h_v$ is ended once a stop 70 on the valve needle 18 comes to rest on the counterpart stop 72 of the intermediate liner 46. The valve needle 18 remains in this position until the continually increasing fuel pressure also overcomes the contrary forces of both closing springs 26, 28. After that, the valve needle 18 is moved onward in the opening direction along with the intermediate liner 46 until after a remaining stroke $h_h$ when it has executed its entire stroke. This stroke is limited by the counterpart stop 74 on the shim 12 which is struck by the stop 76 on the intermediate liner 46.

The invention is not limited to the exemplary embodiment shown and described. Alternatively, instead of the grooves 56 in the shoulder part 50, recesses of other shape, such as intersecting grooves or uniformly distributed countersunk depressions may be provided. In the same way, the recesses 60 on the retaining body 16 may have a different shape from that of blind bores, or may even be entirely absent.

The spring assembly described above is especially suitable for so-called seat-hole nozzles, in which the prestroke is in the range from 0.01 to 0.1 mm. In these injection nozzles, the disposition of the injection ports is preferably such that they are covered entirely or partly by the valve needle, and only part of the injection port cross section is uncovered in the prestroke.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection nozzle for internal combustion engines having a nozzle body (10), said nozzle body is secured in place between a nozzle holder (16) and a union nut (14), a valve needle (18) which is displaceably supported in said nozzle body, the nozzle holder including a spring chamber, embodied as an axial blind bore with a substantially constant diameter over its length, for receiving first and second closing springs disposed in series and acting successively upon the valve needle and embodied as helical compression springs, of which the first closing spring, more remote from the nozzle body, is supported on a bottom of the blind bore and acts upon the valve needle via a thrust bar that penetrates the second closing spring, said second closing spring is located closer to the nozzle body and supported on a shoulder part (50) secured in the nozzle holder, the shoulder part (50) is adapted in its outside diameter to the inside diameter of the blind bore (25) and introduced into the blind bore and secured form-fittingly by means of a radial plastic deformation of at least a part of a contacting wall of the nozzle holder (16) in a plane with said shoulder part (50).

2. An injection nozzle as defined by claim 1, in which the shoulder part (50), embodied as a ring, has recesses (56) on its circumference, into which recesses, parts (64) of the wall of the nozzle holder (16) are deformed.

3. An injection nozzle as defined by claim 2, in which the recesses take the form of annular grooves (56).

4. An injection nozzle as defined by claim 1, in which the shoulder part (50) is introduced into the blind bore (25) with little play.

5. An injection nozzle as defined by claim 2, in which the shoulder part (50) is introduced into the blind bore (25) with little play.

6. An injection nozzle as defined by claim 3, in which the shoulder part (50) is introduced into the blind bore (25) with little play.

7. An injection nozzle as defined by claim 1, in which the shoulder part is pressed into the blind bore (25).

8. An injection nozzle as defined by claim 2, in which the shoulder part is pressed into the blind bore (25).

9. An injection nozzle as defined by claim 3, in which the shoulder part is pressed into the blind bore (25).

10. An injection nozzle as defined by claim 4, in which the shoulder part is pressed into the blind bore (25).

11. An injection nozzle as defined by claim 5, in which the shoulder part is pressed into the blind bore (25).

12. An injection nozzle as defined by claim 6, in which the shoulder part is pressed into the blind bore (25).

13. An injection nozzle as defined by claim 1, in which recesses (60) are disposed in a portion of the wall of the nozzle holder (16) located in the region of the shoulder part (50), of which recesses the part of the nozzle holder forming the bottom is deformed to form a form-fitting connection with the recesses (56) of the shoulder part.

14. An injection nozzle as defined by claim 2, in which recesses (60) are disposed in a portion of the wall of the nozzle holder (16) located in the region of the shoulder part (50), of which recesses the part of the nozzle holder forming the bottom is deformed to form a form-fitting connection with the recesses (56) of the shoulder part.

15. An injection nozzle as defined by claim 3, in which recesses (60) are disposed in a portion of the wall of the nozzle holder (16) located in the region of the shoulder part (50), of which recesses the part of the nozzle holder forming the bottom is deformed to form a form-fitting connection with the recesses (56) of the shoulder part.

16. An injection nozzle as defined by claim 4, in which recesses (60) are disposed in a portion of the wall of the nozzle holder (16) located in the region of the shoulder part (50), of which recesses the part of the nozzle holder forming the bottom is deformed to form a form-fitting connection with the recesses (56) of the shoulder part.

17. An injection nozzle as defined by claim 5, in which recesses (60) are disposed in a portion of the wall of the nozzle holder (16) located in the region of the shoulder part (50), of which recesses the part of the nozzle holder forming the bottom is deformed to form a form-fitting connection with the recesses (56) of the shoulder part.

18. An injection nozzle as defined by claim 6, in which recesses (60) are disposed in a portion of the wall of the nozzle holder (16) located in the region of the shoulder part (50), of which recesses the part of the nozzle holder forming the bottom is deformed to form a form-fitting connection with the recesses (56) of the shoulder part.

19. An injection nozzle as defined by claim 7, in which recesses (60) are disposed in a portion of the wall of the nozzle holder (16) located in the region of the shoulder part (50), of which recesses the part of the nozzle holder forming the bottom is deformed to form a form-fitting connection with the recesses (56) of the shoulder part.

20. An injection nozzle as defined by claim 13, in which the recesses (60) are embodied as countersunk depressions.

* * * * *